United States Patent [19]

Tuovinen et al.

[11] Patent Number: 4,458,352

[45] Date of Patent: Jul. 3, 1984

[54] METHOD AND DEVICE PROVIDING MOBILITY TO A CONTACT SHOE INDEPENDENT OF AN ELECTRODE IN AN ELECTRIC-ARC FURNACE

[75] Inventors: Frans H. Tuovinen, Ulvila, Finland; Risto M. Heikkilä, Haparanda, Sweden; Martti J. Jankkila, Kiviranta, Finland; Bengt J. F. Norrman, Helsinki, Finland; Matti E. Honkaniemi, Tornio, Finland

[73] Assignee: Outokumpu Oy, Outokumpu, Finland

[21] Appl. No.: 336,931

[22] Filed: Jan. 4, 1982

[51] Int. Cl.[3] ..... H05B 7/11; H05B 7/12

[52] U.S. Cl. ..... 373/101

[58] Field of Search ..... 373/101, 96, 94, 100, 373/89, 97

[56] References Cited

U.S. PATENT DOCUMENTS 2,226,747 12/1940 Sem ..... 373/101

*Primary Examiner*—Roy N. Envall, Jr.

*Attorney, Agent, or Firm*—Limbach, Limbach & Sutton

[57] ABSTRACT

A method and device for facilitating the maintenance and replacing of the contact shoes of the electrodes in an electric-arc furnace, the supporting mantle of the contact shoes consisting of two sections, the lower one of which can be lifted, together with the contact shoes, telescopically over the upper section, whereby the contact shoes rise above the furnace hood.

8 Claims, 2 Drawing Figures

METHOD AND DEVICE PROVIDING MOBILITY TO A CONTACT SHOE INDEPENDENT OF AN ELECTRODE IN AN ELECTRIC-ARC FURNACE

BACKGROUND OF THE INVENTION

1. Field of the Invention

The present invention relates to a method and device for facilitating the maintenance and replacement of the contact shoes of the electrodes in an electric-arc furnace. The invention also relates to a method and device by means of which it is possible to repair and replace even other devices possibly in connection with the lower end of contact shoes of the electrodes in an electric-arc furnace.

2. Description of the Prior Art

The conventional method for the maintenance of the contact shoes of the electrodes in an electric-arc-furnace is that the furnace is disconnected from the power supply and it is allowed, or at least its surface parts are allowed, to cool. Then the maintenance man crawls inside the hood of the furnace, which is a very hot and dusty place to work in, where the lighting and other working conditions are likely to cause accidents. In an alternative maintenance procedure, the entire electrode is lifted out of the charge to above the furance hood, where the repairs are then carried out. Starting the furnace is, however, a very difficult and time-consuming operation, since it is necessary to make the electrode sink through the solid bed into the melt before it works at full power and before the production reaches full capacity, a fact which causes great financial losses.

SUMMARY OF THE INVENTION

The object of the present invention is to provide a method and device for facilitating the maintenance and replacing of the contact shoes of the electrodes in an electric-arc furnace, whereby the method and device make the maintenance and the replacement safer and easier compared with what is known in the prior art.

The method and device according to the present invention allow the maintenance to be done over the hood of the electric-arc furnace and thus there is no need to wait for cooling of the furnace before the maintenance can be effected. Additionally there is no need to effect the maintenance under the hood in dusty conditions and in a place where the possibility of accidents is always present.

The aforementioned improvements are accomplished, however, in a simple and inexpensive way.

Thus, according to the invention, the support mantle of the contact shoes is divided into two sections, the lower one of which can be telescopically lifted over the upper one and thus the contact shoes rise above the hood of the furnace. The shoes can be easily repaired and replaced if necessary above the hood of the electric-arc furnace.

BRIEF DESCRIPTION OF THE DRAWINGS

The invention is described below in greater detail with reference to the accompanying drawings, in which depict different views of a device of the present invention.

DESCRIPTION OF THE PREFERRED EMBODIMENT

Figure 1A:
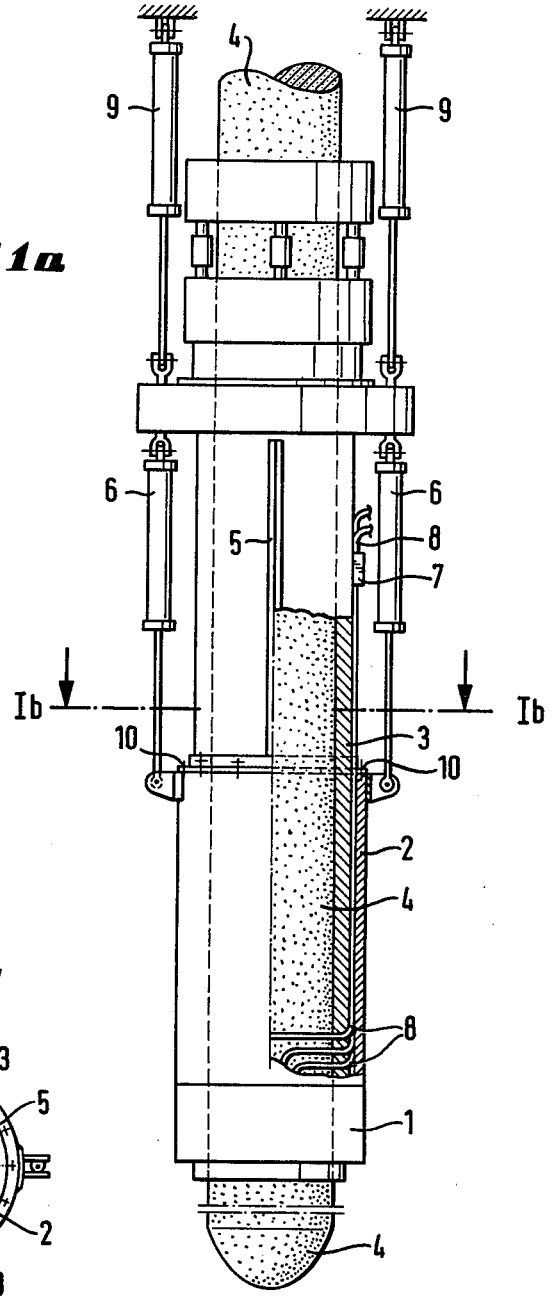
FIG. 1*a* depicts the device in the operational position in which the lower section of the contact shoe supporting mantle is in an extended position.
Figure 1B:
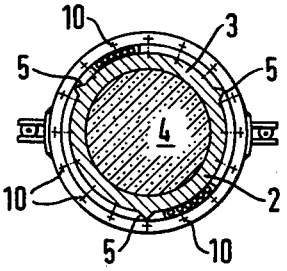
FIG. 1*b* depicts a horizontal cross section view of FIG. 1*a*.

In the figures, the contact shoes are indicated by reference numeral 1, and they are situated in the lower part of the electrode 4 and are held around the electrode by pneumatic pressure, for example. Above the contact shoes there is a shoe-supporting mantle, which is divided into a lower section 2 and an upper section 3. The joint between the sections is indicated by 10. The holder through which current and cooling water are fed to the contact shoes is indicated by 7, and the water pipes and electric wires passing from there to the shoes are indicated by 8. In addition, the device includes guides 5 and hydraulic cylinders 6, the operation and purpose of which is described below.

The prior known solution as regards the supporting mantle is one which has only one mantle which thus forms a fixed entity. Usually the device also includes two hydraulic cylinders, which are indicated in the figure by numeral 9. Their operation is connected with the slipping device. In accordance with the present invention, the supporting mantle, is divided into two sections, and the lower section of the supporting mantle has been explained to such an extent that it fits telescopically over the upper section. During normal use there is between the sections either a flange contact fixed with bolts, or the sections are, for example, push-pull locked to each other. When malfunction is observed in the operation of the contact shoes, the contact shoes are detached from around the electrodes by easing the pressure on the shoes, the joint between the supporting mantles is opened, and the lower supporting mantle is lifted by means of the hydraulic cylinders 6. In this situation the guides indicated by 5 are also necessary; they ensure that the sections of the supporting mantle remain in the desired position in relation to each other. It should be noted that in this embodiment the upper and the lower section of the supporting mantle should be electrically insulated from each other.

In accordance with the invention, the contact shoes can be lifted above the furnace hood, where the maintenance or replacement can be carried out easily and safely.

If the method and device according to the invention are used in new constructions, it is advantageous that the functions of the hydraulic cylinders 6 and 9 are combined, in which case a total of two cylinders will be sufficient.

Even though the use of only hydraulic cylinders is described above for the lifting mechanism, it is self-evident for an expert in the art that even other alternatives known in the field can be used for the lifting purpose.

What is claimed is:

1. A method for providing mobility to a contact shoe independent of an electrode in an electric-arc furnace, comprising the steps of:

(a) providing said contact shoe with a hollow supporting mantle having an inner member with an inner and outer surface and an outer member with a lower and an upper end;

(b) positioning the electrode within said inner member;

(c) detachably attaching and telescopically fitting said outer member to and over said inner member;

(d) attaching the contact shoe to one end of said outer member; and (e) providing a telescopically lifting means to said outer member and the contact shoe attached thereto for lifting the contact shoe over said inner member.

2. A method according to claim 1, wherein the telescopically lifting means is a hydraulic cylinder.

3. A method according to claim 1, further comprising placing guides on the outer surface of said inner member to direct the telescopic lifting of said outer member over said inner member.

4. A device for providing mobility to a contact shoe independent of an electrode in an electric-arc furnace, comprising:

(a) a contact shoe supporting mantle having an inner member and a mobile outer member detachably attached to and telescopically fitted over said inner member;

(b) said inner member having an inner and an outer surface and containing the electrode;

(c) said outer member having a lower end and an upper end and having the contact shoe attached to the lower end; and (d) means for telescopically lifting said outer member and the contact shoe attached thereto over said inner member.

5. A device according to claim 4, wherein the means for telescopically lifting said outer member over said inner member is a hydraulic cylinder.

6. A device according to claim 4, further comprising guides placed on the outer surface of said inner member for directing the telescopic lifting.

7. The device of claim 4, wherein the contact shoe supporting mantle is substantially cylindrically shaped.

8. The device of claim 4, wherein said inner member and said outer member are substantially cylindrically shaped.

* * * * *